United States Patent [19]

Di Franco

[11] 4,023,271

[45] May 17, 1977

[54] MEAT TRIMMER AND SCRAPER ASSEMBLY

[76] Inventor: Roy P. Di Franco, 788 Lusterleaf Drive, Sunnyvale, Calif. 94086

[22] Filed: Aug. 8, 1975

[21] Appl. No.: 610,975

[52] U.S. Cl. ..... 30/123; 30/172; 7/1 A

[51] Int. Cl.[2] ..... B26B 3/04

[58] Field of Search ..... 30/136, 162, 172, 142; 17/66, 19; 15/236 R; 7/1 A, 1 B, 1 H, 15

[56] References Cited

UNITED STATES PATENTS

| | | | |
|---|---|---|---|
| 717,408 | 12/1902 | Jacobsen | 7/1 A |
| 1,434,388 | 11/1922 | Hughes | 30/162 X |
| 1,920,954 | 8/1933 | Benedict | 30/162 X |
| 2,105,663 | 1/1938 | Laverty | 30/162 |
| 2,449,092 | 9/1948 | Struble | 30/172 X |
| 2,870,537 | 1/1959 | Ortner | 30/162 |
| 3,795,026 | 3/1974 | Kazamek | 15/236 R |

*Primary Examiner*—Al Lawrence Smith
*Assistant Examiner*—J. C. Peters

[57] ABSTRACT

A meat trimmer and scraper embodied in a single, safe, easily used tool with the scraper extending at an angle from one end of the handle and a trimmer blade extending from the same end adjacent the scraper whereby in one orientation of the handle meat can be scraped while in another orientation the meat can be trimmed.

6 Claims, 10 Drawing Figures

MEAT TRIMMER AND SCRAPER ASSEMBLY

BACKGROUND OF THE INVENTION

This invention relates generally to meat cutter's tools and more particularly to meat cutters, trimmer and scraper.

The preparation of various meats cuts for retail market sales includes trimming of fat, and whenever a band saw has been used in the process of cutting the meat, the scraping of the meat cuts to remove bone dust as well as fat and/or meat particles, it is done prior to packaging or placing in the market's meat counter for sale. Presently, the scraping operation is carried out by a tool which includes a plurality of flexible, substantially concentric circular bands attached to a handle whereby as the bands are scraped across the meat they sequentially engage and scrape the meat to scrape off any of the bone dust, fat and meat particles. The trimming operation is carried out by a separate tool, a sharp knife, either plain or serrated. The trimming and scraping operations are essential but often require a disproportionate portion of the meat cutter's time because of the requirement that the meat cutter first use the scraper, lay it down, and then pick up the knife to perform the trimming operation.

OBJECTS AND SUMMARY OF THE INVENTION

It is an object of the present invention to provide a meat cutter's tool combining both a trimmer and scraper in a single, easily used and safe tool.

It is a further object of this invention to provide a tool which increases the efficiency of meat cutters by substantially reducing the time required for them to complete the trimming and scraping of meat.

It is a further object of the present invention to provide a combination tool in which the trimming blade may be retracted for storage and safety.

It is a further object of the present invention to provide a combination trimmer and scraper in which the knife blades and scraping bands are easily removable for quick replacement when necessary.

It is still a further object of the present invention to provide a combination trimmer scraper in which the scraping bands have a unique design to prevent surface damage during the scraping operation to give longer lasting, better looking meat cuts.

The foregoing and other objects of the present invention are achieved by a tool which includes a handle adapted to receive a replaceable trimming blade, means for retracting the blade into the handle and locking it in various positions, and, in addition, a plurality of bands secured to and extending at an angle from the handle.

DESCRIPTION OF PREFERRED EMBODIMENTS

Figure 5:
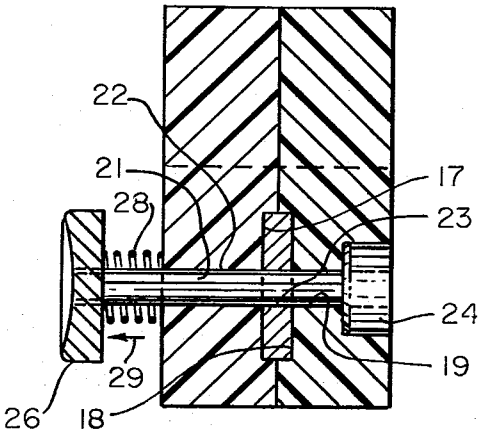
FIG. 5 is a sectional view taken along the line 5—5 of FIG. 2.
Figure 3:
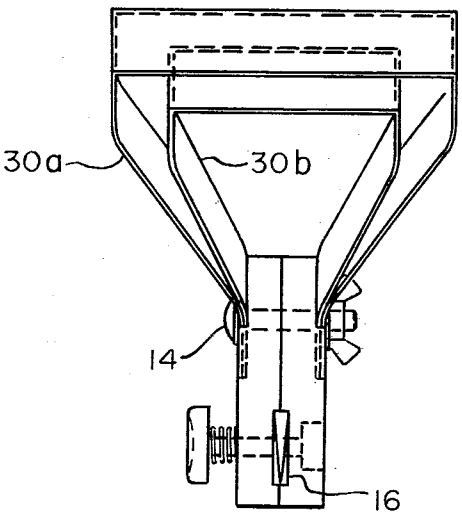
FIG. 3 is a front elevational view of the trimmer scraper.
Figure 1:
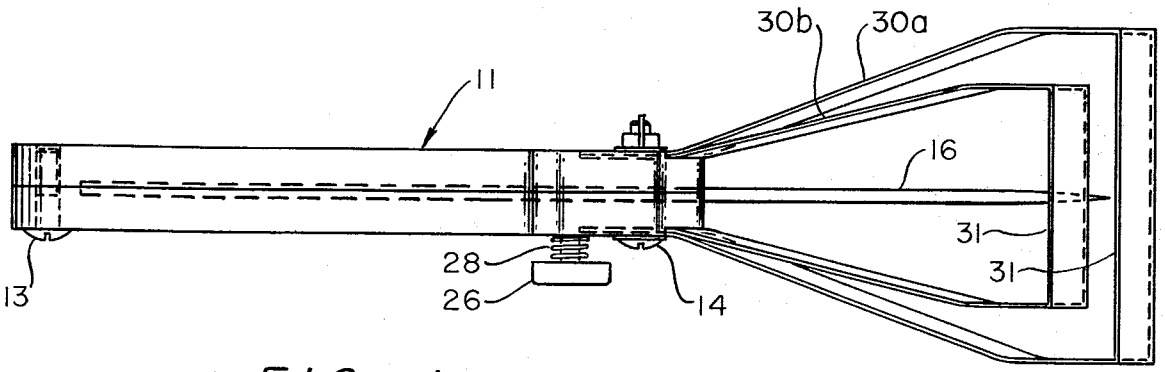
FIG. 1 is a plan view of a trimmer scraper in accordance with the invention.
Figure 4:
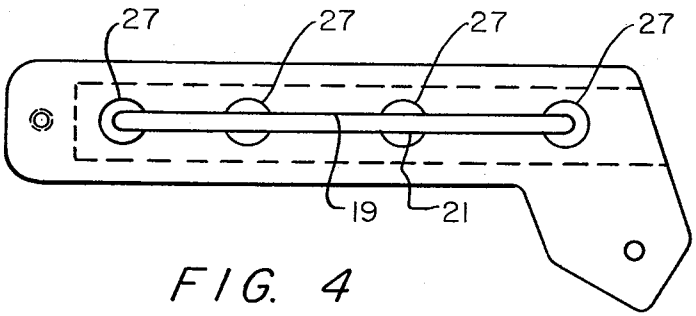
FIG. 4 is a rear elevational view.
Figure 2:
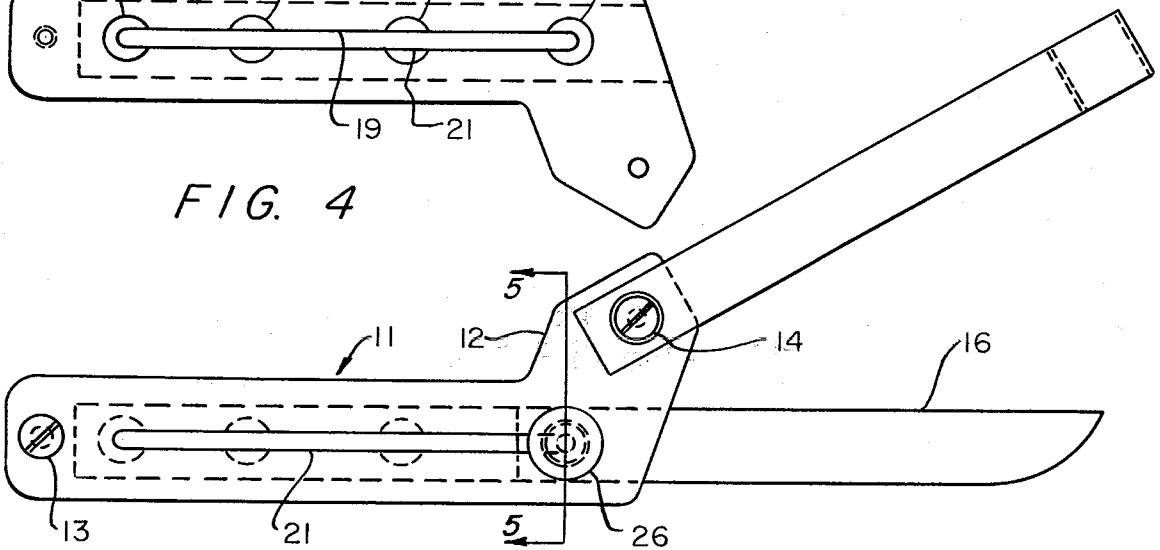
FIG. 2 is a side elevational view of the trimmer scraper.
Figure 7:
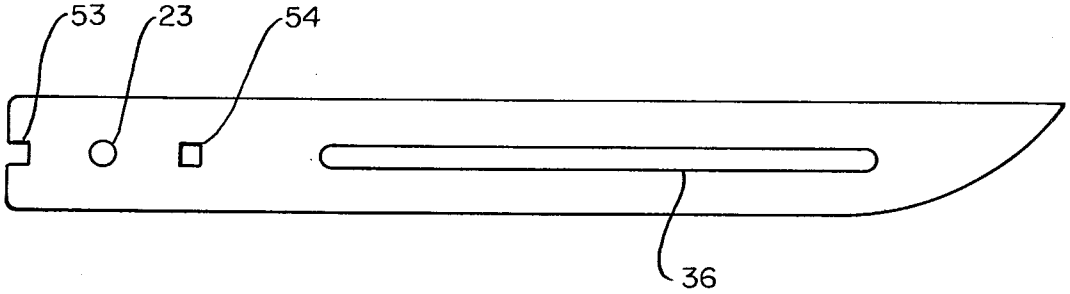
FIG. 7 is an elevational view of the cutting blade for another embodiment.
Figure 6:
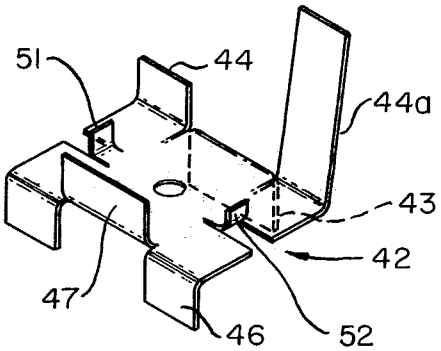
FIG. 6 is a perspective view of a blade moving and locking member in accordance with another embodiment of the invention.
Figure 8:
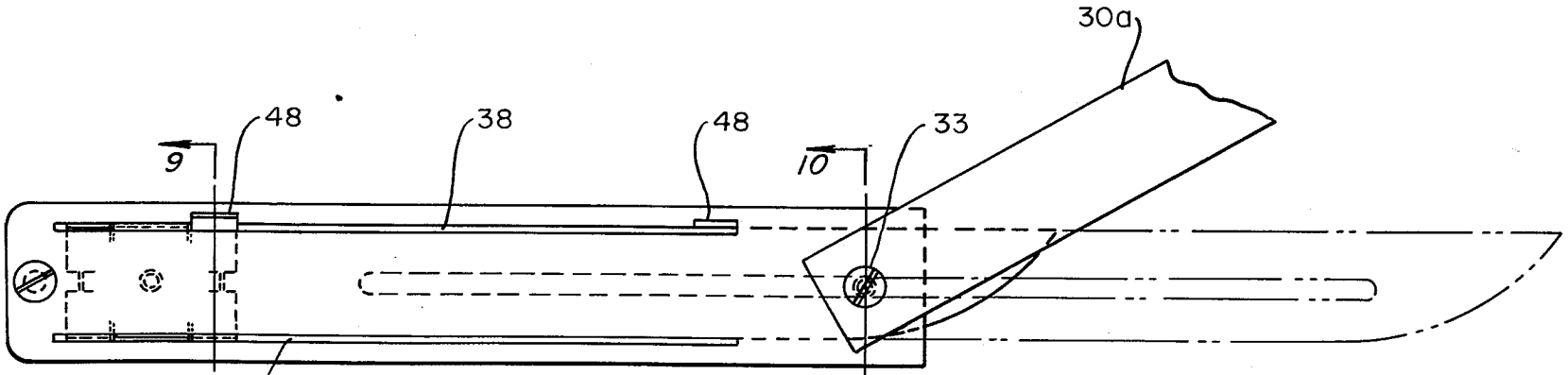
FIG. 8 is a side elevational view of said another embodiment of the trimmer scraper.
Figure 10:
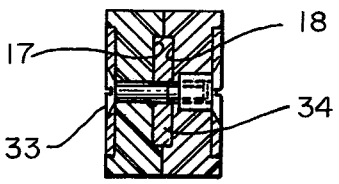
FIG. 10 is a sectional view taken along the line 10—10 of FIG. 8.
Figure 9:
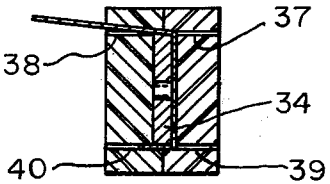
FIG. 9 is a sectional view taken along the line 9—9 of FIG. 8.

Referring to the figures, the tool includes a handle 11 which may include an angularly extension portion 12. The handle may, for example, be made of molded plastic or other suitable material and may be in the form of two pieces held together by screws 13 and 14. As will be presently described, screw 14 may also serve to replaceably retain the scraping bands. The two halves of the handle are so constructed that they provide an elongated recess adapted to snugly slidably received a trimmer blade 16. For example, the two sections of the handle may include elongated grooves 17 and 18 which cooperate to form the elongated recess. In addition, elongated slots 19 and 21 (FIGS. 2, 4 and 5) are formed in each side of the handle portions and extend substantially the entire length of the handle portions. The blade holding, retracting and locking assembly extends through these slots. The assembly is more clearly shown in FIGS. 4 and 5 and comprises a blade holding pin 22 which extends through hole 23 formed in the blade. A locking head 24 is formed on one end of the pin and the other end threadably receives a button 26 at its opposite end. The slot 19 is provided with a plurality of arcuate notches 27 which are adapted to receive the head 24. A spring 28 serves to urge the locking and retracting button in the direction shown by the arrow 29 which causes the head 24 to move into one of the locking notches 27 when it is aligned with it. To move the blade, the button 26 is depressed whereby the head 24 lifts out of the associated portion 27 and the pin 22 is permitted to ride along the slots 19 and 21. If the botton 26 is released the blade continues to be moved until the head 24 drops into the next arcuate portion 27. By providing a plurality of arcuate portions 27, the extension of the trimmer blade can be controlled from a fully retracted position to intermediate positions. It is, of course, apparent that other means for retracting and locking the cutting blade in various positions can be employed, and that the one shown is for illustrative purposes only. Thus, it is seen that the blade extends outwardly from the handle as shown in FIGS. 1 and 2 and is available for trimming. When trimming is completed, the blade may be retracted thereby providing an additional safety whereby the meat cutter will not accidently cut himself.

The scrapers in accordance with the present invention include a plurality of bands, two of such bands **30*a*, 30*b* are shown in the present embodiment. The bands are secured to one another at one end as, for example, by welding, thereby straddling the handle and are retained by the screw 14. The bands extend outwardly in a fan shape and are bent to form a straight scraping edge 31.** It is noted that the bands extend outwardly at an angle with respect to the axis of the handle. When scraping, the handle is turned over and the meat is scraped with the flat scraping edges forming an angle with the meat. The edges clean the meat with substantially uniform pressure against the flat surface of the meat. This reduces gouging and damaging of the meat.

The knife blade shown has a razor sharp cutting edge. The blades may include a serrated edge if desired. The type of blade being used is left to the preference of the user since it can easily be interchanged. When the blade is to be changed, the head 26 of the retracting mechanism is removed, the pin 21 removed, the blade removed and a new blade inserted and the retracting mechanism reassembled whereby to provide a new, sharp cutting edge. It is seen that the blade is easily interchangeable and replaced by removal of a single screw included as part of the retracting and locking assembly. It is also noted that the scraper assembly is removable by removing the screw 14 and replacing the scraper blades.

The scrapers preferably form essentially a 30° angle with the handle. They may, for example, comprise ⅝ inch wide and 0.017 inch thick spring stainless steel bands with a three inch portion 31 for the outer band and a two inch portion 31 for the inner band. The overall length of the scraper assembly may be in the order of 5½ inches. The handle is approximately 4 inches long, giving a total length of 9½ inches.

In the embodiment shown in FIGS. 6 through 10, the two piece handle 11 does not include an extending portion 12. The scraper blades 30*a*, 30*b* are secured to the handle by a screw 33 which also serves to hold the handle together. The handle includes grooves 17 and 18 which receive the blade 34. The blade 34 includes an elongated slot 36 which permits the blade to move with respect to the scraper blade retaining and handle holding screw 33. The handle pieces include elongated spaced pairs of cooperating slots 37,38 and 39,40. A blade holding, retracting and locking member 42 has ears 43,44 and 46,47 which ride in the grooves 37,38 and 39,40 respectively. The ear 44*a* extends beyond the side of the handle and is adapted to engage the notches 48 formed on the upper side of the slot 38. The member 42 includes ears 51 and 52 which engage notch 53 and hole 54 on the end of the blade.

The ear 44*a* is used to move the blade between its extended and retracted positions and to lock the blade. Before the blade can be moved the ear is bent downwardly so that it is released from its cooperating notch and can move along the slot. When it is released it springs upwardly and engages the next cooperating notch.

There is provided an improved combination tool which offers unique advantages, not only in costs since a single tool is required, but in time saved by the meat cutter, thereby providing greater output. The tool trimmer-scraper blades are easily replaceable, reducing the replacement costs when the cutter or scraper is dulled.

What is claimed is:

1. A meat trimmer-scraper comprising a trimmer blade, at least one scraper blade in the form of an elongated band, an elongated handle having spaced sides, means for securing the ends of said at least one scraper blade band to the sides at one end of said handle at an angle with respect to the londitudinal axis of the handle so that the edge of said band engages the meat at an angle when the handle is parallel to the meat, and means formed in said handle for receiving and holding said trimmer blade having a cutting edge so that it extends outwardly from said one end of the handle adjacent said scraper blade and substantially parallel to the handle's longitudinal axis with the cutting edge extending in the opposite direction than the scraper blade whereby when the trimmer-scraper is turned over to trim meat there is no interference with the scraper and vice versa.

2. A trimmer-scraper as in claim 1 wherein said last named means permits the trimmer blade to be retracted into the handle.

3. A trimmer-scraper as in claim 1 in which said scraper blade band is bent in the shape of a fan with a straight scraping edge.

4. A trimmer-scraper as in claim 2 wherein said means for holding and moving said trimmer blade includes means cooperating with the handle for locking said trimmer blade at selected positions along said handle.

5. A meat trimmer-scraper comprising an elongated handle, a plurality of bands each formed in the shape of a fan with straight scraping edges and adapted to be interleaved within one another with adjacent scraping edges parallel and spaced from one another, the adjacent ends of said bands extending next to one another, means for securing the adjacent ends of said bands to one end of said handle with the bands extending outwardly from the handle at an angle with respect to the longitudinal axis of the handle whereby the edges of the straight scraping edges engage the meat at an angle when the handle is substantially parallel to the surface being scraped, a trimmer blade carried by said handle and extending parallel to the handle from said one end with its cutting edge arranged to extend opposite said scraper blades whereby when the trimmer-scraper is turned over to trim meat with the trimming blade there is no interference with the scraper and vice versa.

6. A meat trimmer-scraper as in claim 5 in which said handle includes means for retractably receiving said trimmer blade, a blade holding, retracting and locking member including at least one ear for holding the blade, said handle including spaced parallel longitudinal slots with one of said slots including notches, said member including a plurality of ears adapted to ride in said slots, one of said ears extending outwardly to be grasped to move the blade and released to engage a notch to lock the blade.

* * * * *